US007491007B2

(12) United States Patent
Burrows

(10) Patent No.: US 7,491,007 B2
(45) Date of Patent: Feb. 17, 2009

(54) DUAL PIN TURRET LOCK FOR MILITARY VEHICLE

(75) Inventor: Ward C. Burrows, Pasadena, CA (US)

(73) Assignee: Ancra International, LLC., Hawthorne, CA (US)

( * ) Notice: Subject to any disclaimer, the term of this patent is extended or adjusted under 35 U.S.C. 154(b) by 139 days.

(21) Appl. No.: 11/496,033

(22) Filed: Jul. 25, 2006

(65) Prior Publication Data

US 2008/0131198 A1 Jun. 5, 2008

(51) Int. Cl.
*F41A 23/24* (2006.01)

(52) U.S. Cl. ..... 403/324; 403/322.1; 89/37.11; 89/40.12

(58) Field of Classification Search ..... 403/109.3, 403/109.6, 109.7, 319, 321, 322.1, 322.3, 403/322.4, 324, 325, 328, 330; 89/37.07, 89/37.11, 40.12; 292/32, 40, 42, 143, 150, 292/161, 302

See application file for complete search history.

(56) References Cited

U.S. PATENT DOCUMENTS 670,238 A * 3/1901 Kingston ..... 403/322.4
1,449,563 A * 3/1923 Vincent ..... 70/221
2,476,195 A * 7/1949 Horman ..... 74/527
3,443,784 A * 5/1969 Walkinshaw ..... 248/408
3,636,646 A * 1/1972 Drevet ..... 42/44
4,021,126 A * 5/1977 Deeter et al. ..... 403/9
4,383,473 A * 5/1983 Kaustrater ..... 89/40.12
5,018,725 A * 5/1991 Cook ..... 482/103
5,067,268 A * 11/1991 Ransom ..... 42/94
5,353,680 A * 10/1994 Tiomkin et al. ..... 89/37.03
5,865,560 A * 2/1999 Mercat et al. ..... 403/322.4

* cited by examiner

*Primary Examiner*—Robert J. Sandy
*Assistant Examiner*—Joshua T Kennedy
(74) *Attorney, Agent, or Firm*—Edward A. Sokolski

(57) ABSTRACT

The turret of a military vehicle such as a tank is locked in a predetermined position released from this position for installation in another position. The turret has a plurality of holes formed therein arranged in a circular configuration. A pair of lock pins are removably fitted within an adjacent pair of the holes. A single rod is pivotally connected to the lock pins with an operating handle pivotally attached to the rod. Retaining rings are installed on the ends of the rod to retain the lock pins on the rod. The lock pins are angled away from each other and slide on the rod to permit their free entry into adjacent holes. Movement of the handle in a first direction drives the lock pins into adjacent turret holes while movement in the opposite direction withdraws the lock pins from the holes for installation in another pair of holes to change the positioning of the turret.

3 Claims, 1 Drawing Sheet

DUAL PIN TURRET LOCK FOR MILITARY VEHICLE

BACKGROUND OF THE INVENTION

1. Field of the Invention

This invention is related to a system and method for securing the turret of a military vehicle in a predesired position, which can readily be released for installation in another position.

2. Description of the Related Art

Prior art turret locks for military vehicles utilize a single locking pin for retaining a turret in a desired position. The rotatable turret generally has a fixed mounting ring with equally spaced apart apertures in a radial configuration. To position the turret, a single lock pin is installed in any one of the apertures. The turret can be repositioned by relocating the lock pin to another aperture. This prior art device worked well for many years but is now inadequate due to the present use of much heavier weapons and turret armor. The strengthening of the lock pin has been found not to solve the problem as the loads are now so great that the turret ring itself is failing under the loads involved. Repairing the ring is quite difficult and expensive as it is part of the vehicle structure.

SUMMARY OF THE INVENTION

The present invention overcomes the above-indicated shortcomings of the prior art by employing a pair of lock pins, which share the load. The lock pins operate in unison in response to a single control handle for installing and removing and reinstalling the lock pins in adjacent pars of turret holes. The lock pins are angled away from each other to permit their free entry into adjacent holes, the holes being arranged in a radial configuration. The device of the present invention is operable in the same basic manner as the prior art device and therefore can be put into use without any retraining of operating personnel.

The device of the present invention employs a single handle for driving both lock pins into adjacent apertures formed in the fixed turret mounting ring. The single handle is employed to drive a single rod, which is pivotally attached to the lock pin members. In view of the angular difference between the entry angles of adjacent lock pin members into adjacent apertures of the turret ring, the lock pins are angled away from each other to accommodate this difference. Retaining rings are provided on each of the lock pin members to keep the lock pins in retention in the turret holes, yet to permit the withdrawal of the lock pin members for installation in another pair of apertures.

DETAILED DESCRIPTION OF THE INVENTION

Figure 1:
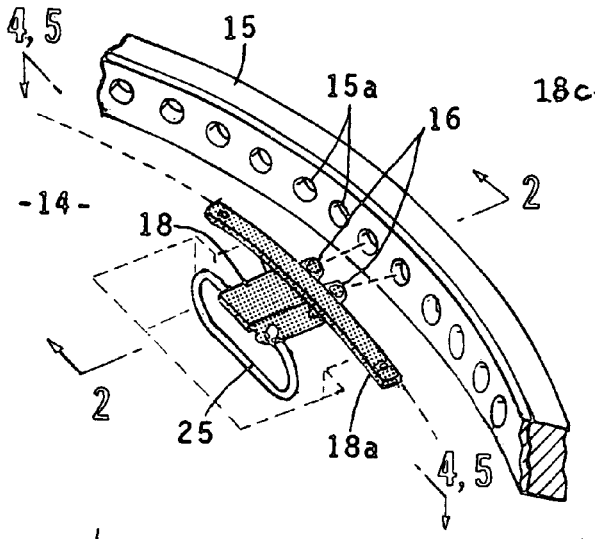
FIG. 1 is an exploded perspective view illustrating the turret lock of the invention immediately prior to its installation in a pair of holes of the turret.

Referring to the drawings, a preferred embodiment of the invention is shown. The top portion of the vehicle, which may be a military tank or utility vehicle, has a rotatable turret 14 with a ring mounting portion 15 fixed to the body of the vehicle. Ring mounting portion 15 has a plurality of equally spaced holes 15*a* formed therein which run all the way around the ring portion.

Figure 3:
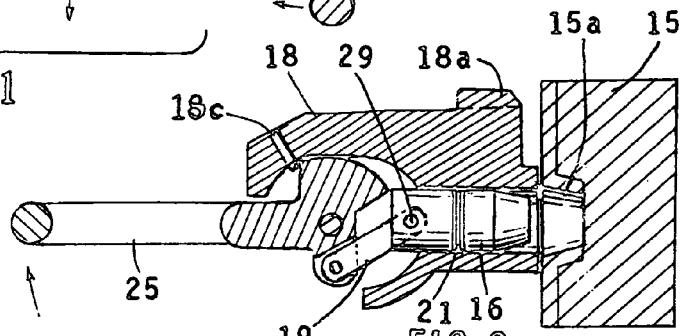
FIG. 3 is a cross sectional view showing one of the lock pins withdrawn from a hole of the turret.
Figure 4:
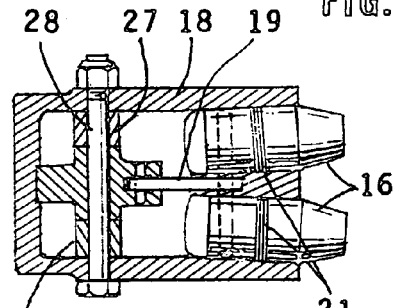
FIG. 4 is a cross sectional view with the lock pins shown in perspective taken along the plane indicated by 4-4 in FIG. 1.

The lock pin assembly includes a housing 18 in which lock pins 16 are contained. The housing has a top portion 18*a* which has a pair of holes on the opposite ends thereof through which screws 31 are fitted for attaching the housing 18 to the rotatable turret 14 of the vehicle. Handle 25 is pivotally supported on shaft 28. The handle is secured against unintentional movement by spring loaded ball detent 18*c*. Spacers 27 are installed along the sides of the handle to keep the handle in correct alignment. Link pin 19 is pivotally connected at one end to handle 25 and at the other end to rod 29, which is slidably connected to lock pins 16. A portion 18*b* of the housing is positioned between the lock pins. Springs 21 are installed on each of the lock pins to keep them firmly seated in the turret holes. The lock pins, as can best be seen in FIGS. 3 and 4 are angled away from each other by a sufficient angle to permit their easy entry into an adjacent pair of holes 15*a*. It has been found that in one model of the invention that this angle was about four degrees total.

Figure 2:
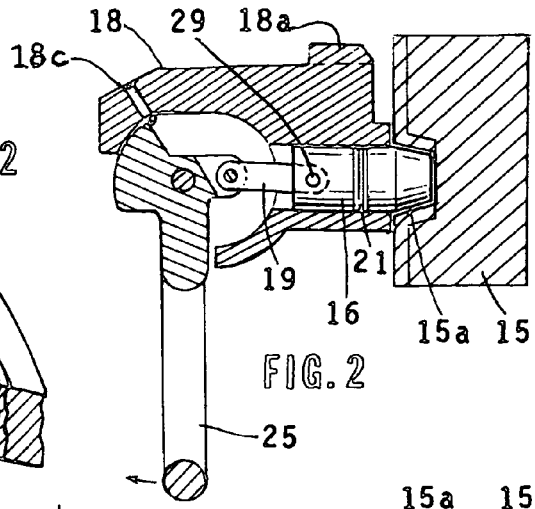
FIG. 2 is a cross sectional view taken along the plane indicated by 2-2 showing one of the lock pins installed in one of the holes of the turret.
Figure 5:
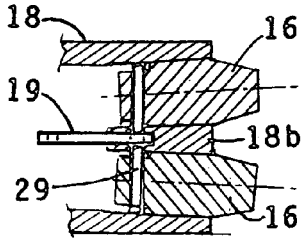
FIG. 5 is a cross sectional view taken along the plane indicated by 5-5 in FIG. 1 with a partial cutaway section.
Figure 6:
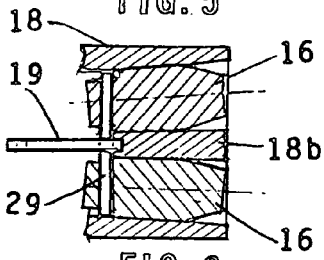
FIG. 6 is a cross sectional view with a partial cutaway section showing the lock pins installed in a pair of adjoining turret holes.
Figure 7:
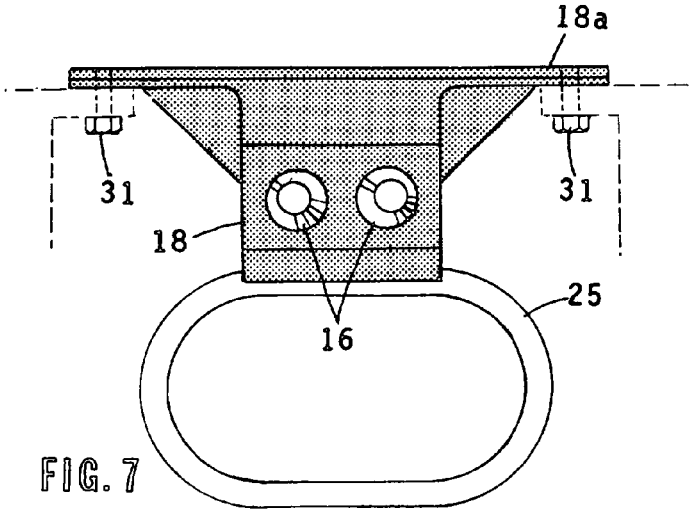
FIG. 7 is a front elevational view showing the housing of the device of the invention temporarily attached to the turret.

The operation of the device of the invention, which can be best seen by reference to FIGS. 2-6, is as follows. With the handle 25 in its raised position, as shown in FIGS. 3 and 6, the pins 16 are withdrawn from holes 15*a* so that there is no locking action of the turret and it is free to move rotatably along the turret ring 15. When the handle is placed in its lowered position, as shown in FIGS. 2,4, and 5, the lock pins 16 are driven together into adjacent holes 15*a* thereby locking the turret in a predesired position.

While the device of the invention has been described and illustrated in detail, this is by way of illustration and example only and is not to be taken by way of limitation, the spirit and scope of the invention being limited by the following claims:

The invention claimed is:

1. A device for locking the turret of a military vehicle in a predetermined position and releasing said turret from said position, comprising a mounting ring fixedly attachable to said vehicle having a plurality of uniformly spaced holes about the interior circumference; and a lock pin assembly comprising:

a housing mountable to said turret;

first and second adjacent lock pin members contained within said housing;

a rod transversely attached to said lock pin members such that said lock pin members are slidably mounted on said rod and said rod is pivotable relative to said lock pin members;

a handle operatively attached to said rod;

said lock pins being angled away from each other by a predetermined amount which corresponds to the axes of any two adjacent holes of the mounting ring and permits their free entry into the adjacent holes; and whereby said first and second lock pins are simultaneously driven by the movement of said handle in a first direction into adjacent holes to lock relative movement of the mounting ring and lock pin assembly and withdrawn from said turret holes with the movement of said handle in an opposite direction to allow for relative movement of the mounting ring and lock pin assembly.

2. The device of claim 1 wherein the predetermined angle is approximately 4 degrees.

3. The device of claim 1 and further including springs on each of said lock pins for keeping said lock pin members firmly seated in the turret holes.

* * * * *